United States Patent [19]

Heinzle

[11] 4,081,167

[45] Mar. 28, 1978

[54] VERTICALLY FLARING CONCRETE FORM

[76] Inventor: Otto Heinzle, Sonderberg 19, Gotzis (Vorarlberg), Austria

[21] Appl. No.: 731,454

[22] Filed: Oct. 12, 1976

[30] Foreign Application Priority Data

Oct. 14, 1975 Austria ..... 7843/75

[51] Int. Cl.[2] ..... B28B 7/28

[52] U.S. Cl. ..... 249/10; 249/184; 249/186; 249/219 W; 249/192

[58] Field of Search ..... 249/1, 10, 11, 142, 249/144, 192, 175, 184, 186, DIG. 1, DIG. 3, 219 W

[56] References Cited

U.S. PATENT DOCUMENTS

| | | | |
|---|---|---|---|
| 637,693 | 11/1899 | Baca | 249/184 |
| 648,244 | 4/1900 | Dever | 249/144 |
| 732,509 | 6/1903 | Boswell | 249/DIG. 3 |
| 793,194 | 6/1905 | Hodgert | 249/1 |
| 804,167 | 11/1905 | Osborn | 249/11 X |
| 845,635 | 2/1907 | Ham | 249/219 W X |
| 850,667 | 4/1907 | Mitchell | 249/184 |
| 894,549 | 7/1908 | Tufts | 249/192 |
| 953,383 | 3/1910 | Holman | 249/219 W X |
| 955,800 | 4/1910 | Hotchkiss | 249/192 |
| 967,836 | 8/1910 | Rodham | 249/192 X |
| 992,782 | 5/1911 | Lambie | 249/11 X |
| 1,585,455 | 5/1926 | Wood | 249/144 X |
| 1,665,650 | 4/1928 | Wood | 249/144 X |
| 2,904,870 | 9/1959 | Hillberg | 249/219 W X |
| 2,940,153 | 6/1960 | Allen | 249/219 W X |
| 3,729,165 | 4/1973 | Trimble | 249/144 |

*Primary Examiner*—J. Howard Flint, Jr.
*Attorney, Agent, or Firm*—Hans Berman

[57] ABSTRACT

A re-usable, convex, conical wall for pouring an upwardly flaring vat consists essentially of axially consecutive, annular form elements having each inner and outer faces connected by two axially spaced edge portions of different length which extend circumferentially about the axis in closed loops. Each form element includes a plurality of plate members fastened to each other in circumferentially juxtaposed relationship. Each pair of axially consecutive form elements is coupled by a first coupling member on the longer edge portion of one element in the pair engaged by a second coupling element on the other element of the pair.

8 Claims, 11 Drawing Figures

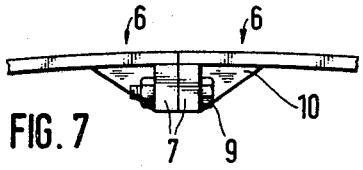
FIG. 7
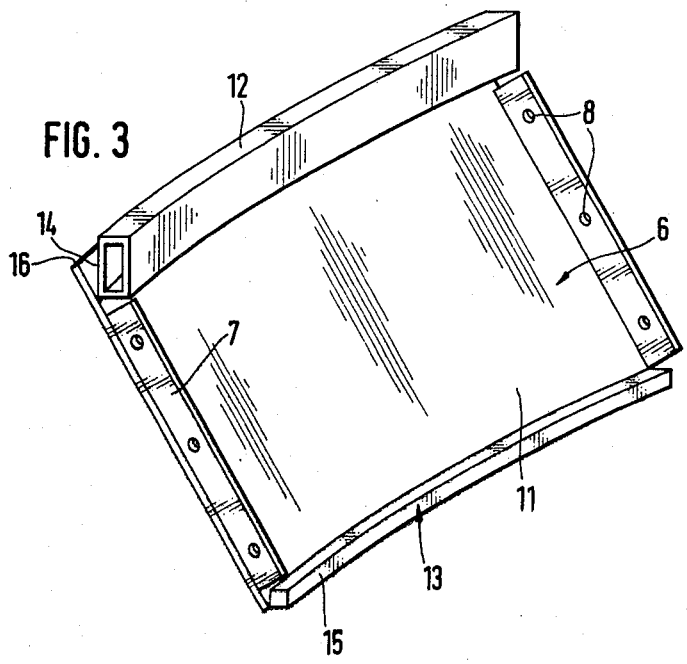
FIG. 3
FIG. 8
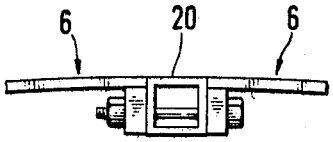
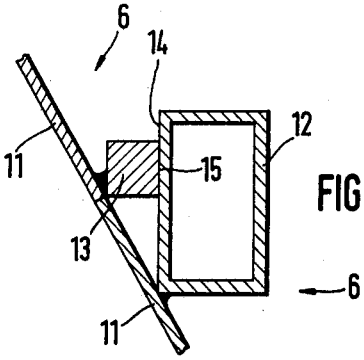
FIG. 5
FIG. 4
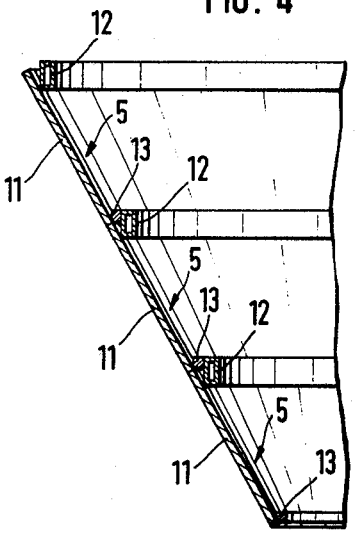

VERTICALLY FLARING CONCRETE FORM

This invention relates to the pouring of concrete, and particularly to a form for pouring a vertically flaring tank or vat.

Tanks, vats, and like containers which have relatively thin, tall walls cannot be poured in a single step. It is necessary to pour annular sections in vertical sequence and to build the form in corresponding steps. If the inner wall of the container flares in an upward direction, it was relatively difficult and time-consuming heretofore to enlarge the convex form wall between the pouring of one batch of concrete mixture and the next. Most of a working day was spent in enlarging the form, and only a small portion of the day was spent on pouring the concrete mixture, causing it to settle by vibration, and related steps.

Tanks of the type described are employed in ever increasing numbers in newly built sewage treatment plants, and the labor cost in the construction of the plants includes a significant amount spent on such concrete tanks. It is a primary object of this invention to reduce the cost of pouring upwardly flaring tanks, and particularly to reduce the time spent on enlarging the form between successively poured batches of concrete mixture.

With these and other objects in view, the invention provides a concrete form having an axis and comprising a plurality of axially consective, annular form elements, each form element having inner and outer faces connected by two axially spaced, circumferentially elongated edge portions. Each edge portion extends about the axis in a closed loop and differs in circumferential length from the other edge portion so that each element flares in an axial direction. Each form element includes a plurality of plate members which are fastened to each other in circumferentially juxtaposed relationship. Interengaged coupling members on respective edge portions of each pair of axially consecutive form elements couple the form elements to each other, one of the coupling members being located on the longer edge portion of one form element of the pair, and the other coupling member on the shorter edge portion of the other form element in the pair.

Whereas the vertically consecutive form sections had to be assembled heretofore from their component parts between successive pouring steps, a time-consuming operation, the annular form elements of the invention are assembled before they are installed on other form elements containing a previously poured batch of concrete mixture, and the erection of the form requires less time then the actual pouring and associated operations performed on the concrete mixture.

Other features, additional objects, and many of the attendant advantages of this invention will readily be appreciated as the same becomes better understood by reference to the following detailed description of a preferred embodiment when considered in connection with the appended drawing in which:

FIG. 3 is a perspective, enlarged view of one of the plate members and associated devices from which the form of FIG. 2 is assembled;

FIG. 4 is a fragmentary, sectional elevation of the form wall of FIG. 2;

FIG. 5 shows a detail of the form of FIG. 4 on a larger scale;

FIG. 7 shows a portion of the form in top plan view;

FIG. 8 shows another portion of the form in a view corresponding to that of FIG. 7;

Figure 1:
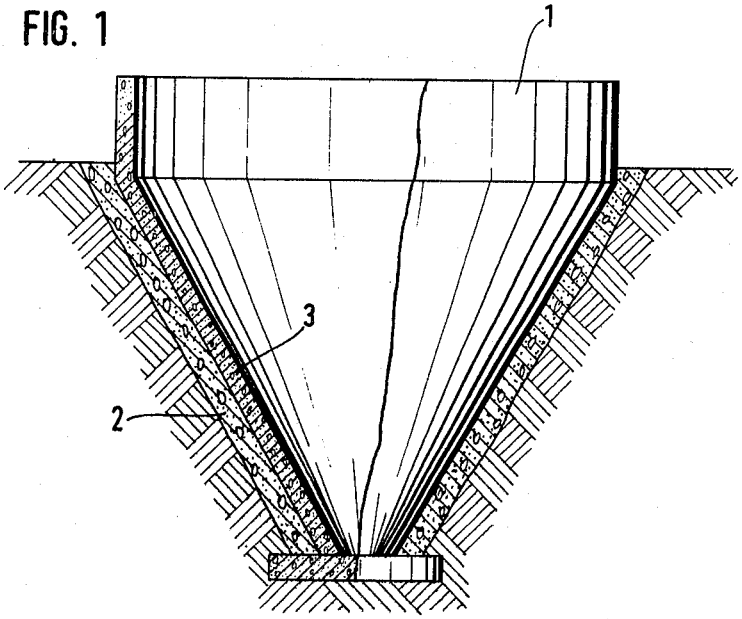
FIG. 1 shows a concrete tank built according to this invention in side elevation and partly in section.
Figure 2:
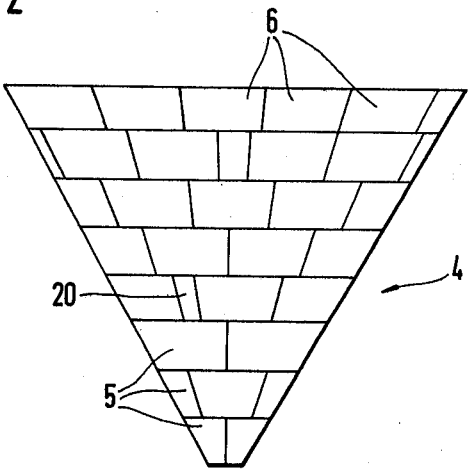
FIG. 2 shows the inner form wall used in building the tank in FIG. 1 in an elevational view.

Referring initially to FIG. 1, there is shown a concrete tank 1 flaring upwardly in a frustoconical shape toward a cylindrical upper rim. The tank 1 is set in an excavation in the ground whose conical wall is reinforced by a layer 2 of lean concrete backing the relatively thin and tall conical wall 3 of the tank 1. The concrete layer 2 also served as the outer wall of the form in which the tank 1 was poured from a concrete mixture, as will presently be described in more detail. The inner wall 4 of the form is shown in FIG. 2. It consists of conically flaring, annular form elements 5 whose outer, convex faces are seen in FIG. 2. Each element 5 is composed of identical, circumferentially juxtaposed, plate-shaped segments 6 and occasional spacers 20.

The segments 6, of which one is seen in detail in FIG. 3, each consist of a quadrangular piece 11 of sheet metal having two diverging straight edges reinforced by flanges 7 which project radially from the conically arcuate, concave face of the sheet metal piece 11. Longitudinally spaced holes 8 in each flange receive bolts 9 in the assembled form element 5 to fasten the several segments 6 to each other in circumferentially juxtaposed relationship, as is shown in FIG. 7. The flanges 7 are welded to the sheet metal of the piece 11 and further stiffened by webs 10, shown in FIG. 7 only.

The circumferential length of a form element 5 is not normally an integral multiple of the corresponding dimension of one segment 6, and spacers 20 may be interposed between segments 6 in the manner evident from FIG. 8 and fastened by the bolts 9 and associated nuts between the flanges 7, the spacers being tubular elements of rectangular cross section and equal in length to the corresponding dimension of the sheet metal pieces 11, as is evident from FIG. 2.

The axially spaced, circularly arcuate edges of the sheet metal piece 11 are reinforced by respective coupling units 12, 13. The slightly shorter coupling unit 13 is a bar of square cross section whose radially outer face is welded to the inner face of the sheet metal piece 11 at a small acute angle which is one half of the apex angle of the conical surface defined by the outer, convex faces of the form elements 5. The inner face 15 of the bar 13 is cylindrically arcuate about the axis of the erected form wall and parallel to the attached outer face.

The longer coupling unit 12 is a metal tube of rectangular cross section, axially longer than it is radially wide. Its radially outer, cylindrical face 14 is welded to the inner face of the sheet 11 at the same angle as the outer face of the bar 13. The angle is chosen in such a manner that the outer face 14 of the tube 12 has the same radius of curvature as the inner face 15 on the coupling unit 13 of the next higher form element 5.

The free circumferential edge or top of the tube 12 projects axially beyond the top edge 16 of the metal sheet 11 to which it is fastened so that a circumferentially elongated edge portion of the sheet and the tube 12 bound a groove open in one axial direction in which the rod 13 of the next higher form element may be received. The inner face 15 of the last-mentioned rod conformingly envelops he outer face 14 of the tube 12, thereby coupling the superimposed pair of form elements 5 to each other by gravity in a position in which the respective sheet metal pieces 11 are aligned flush and edge to edge in a common, conical surface of revolution, as is evident from joint consideration of FIGS. 4 and 5.

Figure 6:
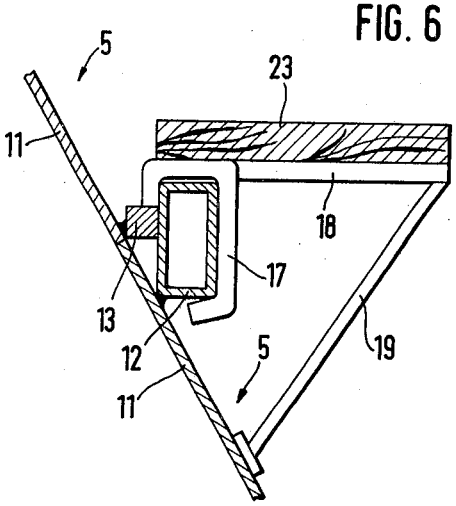
FIG. 6 illustrates another portion of the same form in the manner of FIG. 5.

To avoid separation of the superimposed form elements 5 by buoyancy, as will be described below, resilient wire clasps 17 are distributed circumferentially about the coupled units 12, 13, as is shown in FIG. 6. Each clasp 17 extends in a common plane through the form axis with a bracket consisting of a radial bar 18 having one end fixedly attached to the clasp 17 and of a rod 19 extending from the free end of the bar 18 toward the lower sheet metal piece 11. The clasp 17 envelops the tube 12 and has a transverse end face abutting from above against the top face of the bar 13. A wooden board 23 rests horizontally on two or more brackets 18, 19, and the weight of the board and of a load supported thereon is partly transmitted to the metal sheet 11 by the enlarged lower end of the rod 19 which rests on the sheet.

Figure 10:
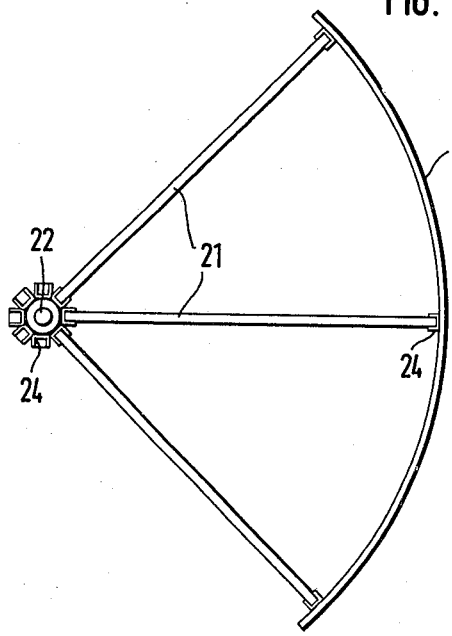
FIG. 10 is a fragmentary top plan view of the completed form of FIG. 2.
Figure 11:
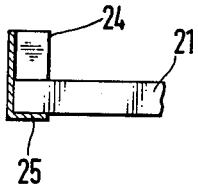
FIG. 11 shows elements of FIG. 10 in enlarged, sectional elevation.

Each form element 5 is precisely centered on a subjacent element by the radially engaged faces 14, 15 of respective coupling units 12, 13 which jointly extend in substantially closed circular loops about the circumference of the form, a bar 13 and tube 12 associated with two axially juxtaposed sheets 11 being longitudinally aligned with corresponding coupling units on adjacent metal sheets 11. In pouring a very large or tall tank, it may be preferred to provide internal bracing for at least some form elements as is partly shown in FIGS. 10 and 11. A tubular column 22 is installed along the axis of the form 4. Short sections 24 of a U-channel are closed in one direction by welded, transverse walls 25, and the webs of the channel sections 24 are welded on a common level to the column 22. Corresponding channel sections are welded to the metal sheets 11 or to the tubes 12 in radial alignment with corresponding channel sections 24 on the column 22. The ends of bars 21 are laid radially in respective channel sections 24 on the column 22 and the form element 5 to balance the radial forces exerted by the concrete mixture on the form.

Figure 9:
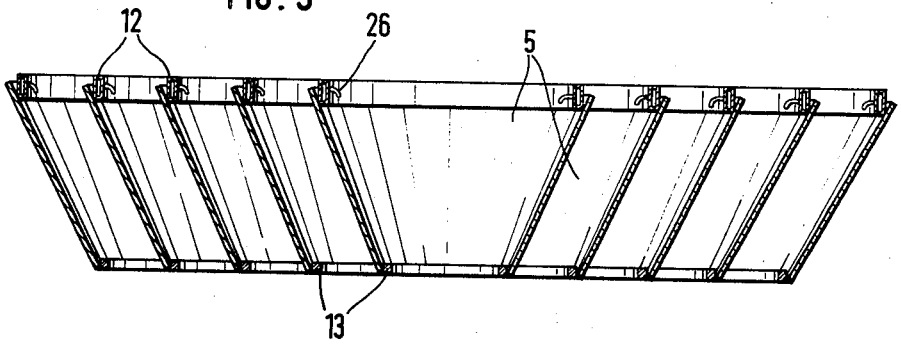
FIG. 9 shows the assembled form elements nested concentrically prior to erection of the form of FIG. 2.

In building the tank 1 shown in FIG. 1, an opening in the ground is excavated to dimensions somewhat greater than the intended outside dimensions of the tank 1. The several form elements 5 are assembled in a remote shop or at the construction site from a set of identical segments 6, spacers 20, bolts 9 and nuts in such a manner that the upper, wider edge of each element 5 matches in diameter the lower, narrower edge of the next larger element 5. A base plate is poured in the bottom of the excavation. The smallest element 5 is temporarily laid aside, and the next larger element is placed on the bottom plate by means of a crane engaging hooks 26 provided at the top edge of each form element, as is shown in FIG. 9, and anchored releasably to the bottom plate in a manner not specifically shown. The dimensions of the excavation are chosen such that the installed element 5 and the earth wall of the excavation bound an annular mold which is filled almost entirely with a lean concrete mixture. Immediately thereafter, the next larger form element is set by the crane on the previously installed element 5, the coupling members 13 of the upper element 5 being inserted in the groove between the tubes 12 and the sheet metal edges 16 of the lower element. The two elements are secured to each other by resilient clasps 17 as may be needed to prevent the second element from rising by its buoyancy when the annular space between the last-installed form element 5 and the earth wall is filled with lean concrete mixture and when the mixture is settled by means of a vibrator. Workmen controlling the pouring operation and the setting in place of the elements 5 may stand on the working platform formed by boards 23.

The steps outlined above with reference to a second form element 5 are repeated sequentially until the surface layer 2 lines the excavation over its entire height. When the layer is sufficiently set, the form elements 5 are removed. It is usually simplest to release one or more spacers 20 from the topmost form element 5, whereupon the remainder of the form element may be taken out of the excavation by the crane, set down in a storage area, and re-assembled there with the previously withdrawn spacer or spacers 20.

After the second-smallest form element 5 is released from the bottom plate and lifted from the excavation, the previously unused smallest form element is installed in the excavation, and a batch of the concrete mixture intended to constitute the tank wall 3 is poured about the form element. The next larger form element is installed, a second batch of concrete mixture is poured, and so on, until the entire conical portion of the wall 3 is poured in the manner described above with reference to the surface layer 2. The cylindrical rim may be formed in any conventional manner.

Because the time required for securing each form element 5 on the next lower element is minimal, a large conical tank of the type illustrated in FIG. 1 may be poured in a single shift. The advantages gained thereby go beyond the saving in direct labor cost. The concrete mixture is utilized more economically, and assembled form elements may be transferred from one construction site to the next for work on the next day.

Only a single size and type of segments 6 is needed for assembling conical forms of different diameter and height, but having the same apex angle. Most of the advantages of this invention are available in the construction of tanks which flare upwardly in a less regular or discontinuous manner, or which are not circular in horizontal section. Actually, the form 4 shown in FIG. 2 may be employed in an obvious manner for pouring a concrete structure which tapers in an upward direction.

Steel and other metals are the preferred materials of construction for building very large tanks according to the invention. However, plastic or plywood panels, flat or curved, may be substituted for the metal sheets 11 under suitable conditions, particularly for building tanks having very light or low circumferential walls, and they may be assembled into annular form elements by fasteners other than flanges releasably connected by bolts and nuts. The necessary modification of the coupling units 12, 13 will be obvious.

The illustrated coupling arrangement between axially consecutive form elements has been found to provide a seal practically impermeable to water and other ingredients of the concrete mixture contained by the form elements. It can be used successfully by unskilled or semi-skilled workers.

The surface layer 2 prevents soil from mixing with the concrete mixture of the tank wall 3 in a manner usually undesirable, but may be dispensed with for a tank not subject to high stress in its normal operation, or where the soil is coherent enough to provide a firm outer form wall. The inner form wall of the invention may be combined with a conventional outer form wall in a manner obvious from the above. The outer wall of a flaring mold does not present the problems inherent in inner mold walls which are surrounded by the form cavity in all horizontal directions, and thus more difficult to support in a conventional manner.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. A concrete form having an axis and a conical, convex surface about said axis, said form comprising:

(a) a plurality of axially consecutive, annular form elements, (1) each form element including a plurality of plate members and fastening means fastening said plate members to each other in a closed loop in circumferentially juxtaposed relationship, (2) each plate member having an outer face constituting a portion of said surface, an inner face parallel to said outer face and obliquely inclined relative to said axis, and first and second, axially spaced, circumferentially elongated edge portions of different length connecting said faces; and (b) first and second coupling members fixedly secured to the inner face of each plate member and projecting from the associated inner face in a radially inward direction axially adjacent said first and second edge portions respectively, (1) said first coupling member projecting axially beyond the adjacent first edge portion, (2) each coupling member having a face cylindrically arcuate about and parallel to said axis of said conical form and conformingly engaging a corresponding face of a coupling member on a plate member of an axially consecutive form element in radially abutting engagement, thereby coupling two form elements to each other.

2. A form as set forth in claim 1, wherein said coupling members are circumferentially elongated and of rectangular cross section.

3. A form as set forth in claim 2, wherein said first edge portion is longer than said second edge portion.

4. A form as set forth in claim 3, wherein said face of said first coupling member is convexly cylindrical and the engaged corresponding face is a cylindrically concave face of a second coupling member.

5. A form as set forth in claim 1, wherein said fastening means include threaded fastening members releasably connecting each plate member to two plate members respectively juxtaposed in opposite circumferential directions.

6. A form as set forth in claim 4, further comprising a plurality of securing members circumferentially distributed about said axis and axially securing respective portions of said first and second coupling members to each other.

7. A form as set forth in claim 6, further comprising a bracket fixedly fastened to each of said securing members, and a work platform supported by a plurality of said brackets.

8. A form as set forth in claim 1, wherein said plate members of each of said form elements are identical.

* * * * *